US010861691B2

(12) United States Patent
Zhang et al.

(10) Patent No.: US 10,861,691 B2
(45) Date of Patent: Dec. 8, 2020

(54) METAL HALIDE LAMP AND MANUFACTURING METHOD THEREOF

(71) Applicant: JUNWA LIGHTING & ELECTRICAL CORPORATION, Nanjing (CN)

(72) Inventors: Changzheng Zhang, Nanjing (CN); Niangen Feng, Nanjing (CN)

(73) Assignee: JUNWA LIGHTING TECHNOLOGY CORPORATION, Jiangsu (CN)

( * ) Notice: Subject to any disclaimer, the term of this patent is extended or adjusted under 35 U.S.C. 154(b) by 0 days.

(21) Appl. No.: 16/476,530

(22) PCT Filed: Aug. 24, 2018

(86) PCT No.: PCT/CN2018/102294
§ 371 (c)(1),
(2) Date: Aug. 30, 2019

(87) PCT Pub. No.: WO2019/205386
PCT Pub. Date: Oct. 31, 2019

(65) Prior Publication Data

US 2020/0126782 A1 Apr. 23, 2020

(30) Foreign Application Priority Data

Apr. 28, 2018 (CN) ..... 2018 1 0412038

(51) Int. Cl.
*H01J 61/82* (2006.01)
*H01J 61/073* (2006.01)

(52) U.S. Cl.
CPC ..... *H01J 61/827* (2013.01); *H01J 61/0732* (2013.01)

(58) Field of Classification Search
None
See application file for complete search history.

(56) References Cited

U.S. PATENT DOCUMENTS 6,222,320 B1 4/2001 Stockwald
8,659,225 B2 2/2014 Panyik et al.
(Continued)

FOREIGN PATENT DOCUMENTS

CN 101310361 A 11/2008
CN 102549709 A 7/2012
(Continued)

OTHER PUBLICATIONS

ISA/CN, International Search Report and Written Opinion, dated Feb. 2, 2019, re PCT International Patent Application No. PCT/CN2018/102294.

(Continued)

*Primary Examiner* — Ashok Patel
(74) *Attorney, Agent, or Firm* — Perry + Currier Inc.

(57) ABSTRACT

The present disclosure relates to the technical field of electric light sources, particularly to a metal halide lamp and a manufacturing method thereof. The metal halide lamp includes an electric arc tube, an inner glass bulb, and a lamp holder fixedly connected with the inner glass bulb; the electric arc tube includes a tube body, a positive electrode located inside an electric arc cavity of the tube body and connected with a positive feedthrough inserted in a first leg portion of the tube body, and a negative electrode connected with a negative feedthrough inserted in a second leg portion of the tube body; the electric arc cavity is provided therein with an ignition gas; an outer surface of the first leg portion is provided with a conductive layer and a metal electrical connector, wherein the conductive layer has one end close to and the other end away from an electrode tip of the positive electrode, the metal electrical connector has one end connected with the other end of the conductive layer, and the other end connected with a long molybdenum rod. Security risks in manufacturing, transportation, mounting, utilization, (Continued)

storage, and waste disposal brought about by use of the radioactive material $^{85}Kr$ are avoided in the present disclosure.

19 Claims, 7 Drawing Sheets

(56) References Cited

U.S. PATENT DOCUMENTS

| | | | | |
|---|---|---|---|---|
| 8,766,518 | B2 | 7/2014 | Panyik et al. | |
| 8,860,308 | B2 | 10/2014 | Brauner et al. | |
| 2006/0290285 | A1* | 12/2006 | Lapatovich | H01J 61/125 313/636 |
| 2008/0224614 | A1* | 9/2008 | Woods | H01J 5/48 313/625 |
| 2010/0301746 | A1* | 12/2010 | Koerber | H01J 61/0737 313/633 |
| 2011/0266947 | A1* | 11/2011 | Tu | H01J 61/26 313/573 |
| 2014/0333200 | A1* | 11/2014 | Boroczki | H01J 61/33 313/634 |

FOREIGN PATENT DOCUMENTS

| | | | |
|---|---|---|---|
| CN | 103650103 | A | 3/2014 |
| CN | 103890903 | A | 6/2014 |
| JP | 2001-345076 | * | 12/2001 |
| JP | 2001345076 | A | 12/2001 |

OTHER PUBLICATIONS

SIPO, First Office Action [with English translation], dated Nov. 20, 2018, re Chinese Patent Application No. 201810412038.8.
SIPO, Search Report, dated Nov. 20, 2018, re Chinese Patent Application No. 201810412038.8.

* cited by examiner

METAL HALIDE LAMP AND MANUFACTURING METHOD THEREOF

CROSS-REFERENCE TO RELATED APPLICATION

The present disclosure claims priority to Chinese patent application with the filing number 2018104120388 filed on Apr. 28, 2018 with the Chinese Patent Office, entitled "Metal Halide Lamp and Manufacturing Method thereof", the contents of which are incorporated herein by reference in its entirety.

TECHNICAL FIELD

The present disclosure relates to the technical field of electric light sources, particularly to a metal halide lamp and a manufacturing method thereof.

BACKGROUND ART

Ceramic metal halide lamps, being one type of high-pressure gas electric discharge lamp, are novel lamps more advanced, more efficient, and more reliable than quartz metal halide lamps. An electric arc chamber of an electric arc tube of an existing ceramic metal halide lamp is filled with, as an ignition gas, a mixture of a gas with a suitable pressure and a radioactive material $^{85}$Kr, otherwise, it is hard to ignite and turn on a bulb.

With the development of people's demand to environmental protection, purchasing, manufacturing, transportation, utilization, storage, and waste disposal of the radioactive material $^{85}$Kr are confronted with increasingly strict restrictions, which brings about adverse influences to the manufacturing, selling, and application of the ceramic metal halide lamps, and even threatens survival of related enterprises and industries. Although some existing ceramic metal halide lamps are improved to a certain extent, they still contain a small amount of the radioactive material $^{85}$Kr.

SUMMARY

Contents of the present disclosure include providing a metal halide lamp, so as to solve the technical problem existing in the prior art that the ceramic metal halide lamps contain a small amount of the radioactive material $^{85}$Kr.

Other contents of the present disclosure include providing a manufacturing method of a metal halide lamp, so as to solve the technical problem existing in the prior art that the ceramic metal halide lamps contain a small amount of the radioactive material $^{85}$Kr.

Solutions of the present disclosure are realized by following embodiments:

A metal halide lamp, including an electric arc tube, a lamp holder (lamp base), and an inner glass bulb, wherein the electric arc tube is mounted inside the inner glass bulb, and the lamp holder is fixedly connected with the inner glass bulb;

the electric arc tube includes a tube body, a positive electrode, and a negative electrode; wherein the positive electrode is located inside an electric arc cavity of the tube body, and the positive electrode is connected with a positive feedthrough, and the positive feedthrough is inserted in a first leg portion of the tube body; the electric arc cavity of the tube body is provided therein with an ignition gas, the negative electrode is located inside the electric arc cavity of the tube body, the negative electrode is connected with the negative feedthrough, and the negative feedthrough is inserted in a second leg portion of the tube body;

the positive feedthrough is connected with a positive contact pin of the lamp holder by a short molybdenum rod, and the negative feedthrough is connected with a negative contact pin of the lamp holder by a long molybdenum rod; and an outer surface of the first leg portion is provided with a conductive layer and a metal electrical connector, wherein one end of the conductive layer is close to an electrode tip (head) of the positive electrode, the other end of the conductive layer is away from the electrode tip of the positive electrode, one end of the metal electrical connector is connected with the other end of the conductive layer, and the other end of the metal electrical connector is connected with the long molybdenum rod.

In the solution of the present disclosure, a geometrical distance between the conductive layer and the positive electrode is particularly short, almost one tenth of a geometrical distance between the positive electrode and the negative electrode of the electric arc tube, a much stronger electric field is stacked on the basis of the electric field intensity between the positive electrode and the negative electrodes. Under the effect of the stacked electric field, the negative electrode in the electric arc tube instantaneously emits much more electrons than electrons emitted by a negative electrode of a common electric arc tube without a conductive coating, thus the current is much larger, and the electrode instantaneously becomes more heated under the effect of the large current, the more heated electrode emits more electrons under a high temperature, and under the effect of the electric field, numerous electrons break through the ignition gas inside the electric arc cavity of the electric arc tube, such that glow discharge occurs to the ignition gas. In this way, the electric arc tube of such metal halide lamp no longer needs to contain the radioactive material including $^{85}$Kr to assist the starting of the bulb, avoiding security risks in manufacturing, transportation, mounting, utilization, storage, and waste disposal brought about by use of the radioactive material $^{85}$Kr. Such metal halide lamp has a simple structure, high lumen efficiency, and remarkable economic benefits.

Optionally, the conductive layer includes a first end ring portion and a second end ring portion connected in sequence; wherein the first end ring portion circumferentially surrounds the first leg portion, and the second end ring portion circumferentially surrounds the first leg portion; the first end ring portion is close to the electrode tip of the positive electrode; and the second end ring portion is away from the electrode tip of the positive electrode; one end of the metal electrical connector is connected with the second end ring portion.

Optionally, the conductive layer further includes an intermediate section, and the first end ring portion and the second end ring portion are connected via the intermediate section.

Optionally, a central angle corresponding to a contact arc between the first end ring portion and the first leg portion is 10°~360°; and a central angle corresponding to a contact arc between the second end ring portion and the first leg portion is 10°~360°.

Optionally, the metal electrical connector is in a sheet-like structure, and the sheet-like structure includes an arc-shaped portion, a connecting portion, and a fixing portion, wherein the connecting portion is connected with one end of the arc-shaped portion, the fixing portion is connected with the other end of the arc-shaped portion; the arc-shaped portion is attached to the first leg portion; the connecting portion is connected with the arc-shaped portion, and the connecting portion is further connected with the long molybdenum rod; and the fixing portion is connected with the connecting portion.

Optionally, the connecting portion includes at least two straight-line sections and at least one bending section; and a difference between the number of the straight-line sections and the number of the at least one bending section is 1; end portions of each bending section are connected with the respective straight-line sections; the at least one bending section and the straight-line sections are distributed in an alternating (staggered) manner.

Optionally, each bending section includes a first straight side, a second straight side, and a third straight side connected in sequence; wherein the first straight side and the third straight side are perpendicular to the second straight side respectively; the first straight side is further perpendicular to the straight-line sections; the third straight side is further perpendicular to the straight-line sections; the second straight side is parallel to the straight-line section; the first straight side is close to the arc-shaped portion, and the third straight side is away from the arc-shaped portion.

Optionally, each bending section includes a fourth straight side, a fifth straight side, a sixth straight side, and a seventh straight side connected in sequence; none of the fourth straight side, the fifth straight side, the sixth straight side, and the seventh straight side are parallel to the straight-line sections; the fourth straight side is close to the arc-shaped portion, and the seventh straight side is away from the arc-shaped portion.

Further, an angle formed between the fourth straight side and the fifth straight side is equal to an angle formed between the sixth straight side and the seventh straight side; a length of the fourth straight side, a length of the fifth straight side, a length of the sixth straight side, and a length of the seventh straight side are all equal; an angle formed between the fourth straight side and the respective straight-line section is equal to an angle formed between the seventh straight side and the respective straight-line section.

Optionally, a central angle corresponding to an arc of the arc-shaped portion is 0~360°.

Optionally, a thickness of the sheet-like structure is 0.01 mm~1 mm; a width of the sheet-like structure is 0.5 mm~5 mm.

Optionally, an internal diameter corresponding to the arc of the arc-shaped portion is 3.80 mm~4.20 mm; an external diameter corresponding to the arc of the arc-shaped portion is 3.82 mm~5.20 mm.

Optionally, two opposite end portions of the connecting portion have a distance of 3 mm~15 mm.

Optionally, a thickness of the connecting portion is greater than a thickness of the arc-shaped portion.

Optionally, a height between the second straight side and the straight-line sections is 1 mm~3 mm.

Optionally, a shortest distance between the arc-shaped portion and a place where the first straight side and the respective straight-line section are connected is 2 mm~8 mm.

Optionally, a length of the second straight side is 2 mm~8 mm.

Optionally, a height between the straight-line sections and a place where the fourth straight side and the fifth straight side are connected is 1 mm~3 mm.

Optionally, a shortest distance between the arc-shaped portion and a place where the fourth straight side and the respective straight-line section are connected is 2 mm~4 mm.

Optionally, a distance between the place where the fourth straight side and the respective straight-line section are connected and a place where the fifth straight side and the sixth straight side are connected is 1 mm~2 mm.

Optionally, a space inside the inner glass bulb is in a vacuum state, or the space inside the inner glass bulb is filled with nitrogen.

Optionally, the ignition gas is an inert gas; and the inner glass bulb is further provided therein with a getter.

Optionally, a width of the first end ring portion is 0.2 mm~10 mm; and a width of the second end ring portion is 0.2 mm~10 mm.

Optionally, the width of the first end ring portion is not greater than the width of the second end ring portion.

Optionally, an outer glass bulb is further included, wherein the inner glass bulb is mounted inside the outer glass bulb, and the inner glass bulb is further fixedly connected with the outer glass bulb; and the conductive layer has a thickness of 0.001 mm~1 mm.

Optionally, a thickness of the first end ring portion is greater than a thickness of the intermediate section, and a thickness of the second end ring portion is greater than the thickness of the intermediate section.

Optionally, the conductive layer is coated on the first leg portion.

Optionally, the conductive layer is formed by sintering a metal powder.

Optionally, the conductive layer is formed by sintering an aluminum oxide powder and/or a tungsten powder in a mixed manner.

An embodiment of the present disclosure further provides a manufacturing method of the metal halide lamp according to any one of the above, wherein the manufacturing method includes: providing a conductive layer on a first leg portion of the electric arc tube, and enabling one end of the conductive layer to be close to an electrode tip of a positive electrode, and enabling the other end of the conductive layer to be away from the electrode tip of the positive electrode;

mounting a metal electrical connector on the first leg portion of the electric arc tube, and enabling one end of the metal electrical connector to be connected with the other end of the conductive layer, and enabling the other end of the metal electrical connector to be connected with the long molybdenum rod; and after flushing the space inside the inner glass bulb for multiple times with nitrogen, finally filling nitrogen with a pressure of $1*10^5$ Pa in one operation, then slowly pumping out the nitrogen, wherein when remaining nitrogen has a pressure of 80 Kpa~50 Kpa or 1 KPa~100 pa, an exhaust pipe on the inner glass bulb is sealed off.

Compared with the prior art, the present disclosure has following beneficial effects:

For the metal halide lamp and the manufacturing method thereof provided in the present disclosure, the outer surface of the first leg portion is provided with the conductive layer and the metal electrical connector; wherein one end of the conductive layer is close to the electrode tip of the positive electrode, the other end of the conductive layer is away from the electrode tip of the positive electrode, one end of the metal electrical connector is connected with the other end of the conductive layer, and the other end of the metal electrical connector is connected with the long molybdenum rod; since the geometrical distance between the conductive layer and the positive electrode is particularly short, almost one tenth of the geometrical distance between the positive electrode and the negative electrode of the electric arc tube, a much stronger electric field is stacked on the basis of the electric field intensity between the positive electrode and the negative electrodes. Under the effect of the stacked electric field; the negative electrode in the electric arc tube instantaneously emits much more electrons than electrons emitted by a negative electrode of a common electric arc tube without a conductive coating, thus the current is much larger, and the electrode instantaneously becomes more heated under the effect of the large current; the more heated electrode emits more electrons under a higher temperature, and under the effect of the electric field, numerous electrons break through the ignition gas inside the electric arc cavity of the electric arc tube, such that glow discharge occurs to the ignition gas. Such electric arc tube no longer needs to contain the radioactive material including $^{85}Kr$ to assist the starting of the bulb, avoiding security risks in manufacturing, transportation, mounting, utilization, storage, and waste disposal brought about by use of the radioactive material $^{85}Kr$.

BRIEF DESCRIPTION OF DRAWINGS

In order to more clearly illustrate embodiments of the present disclosure or technical solutions in the prior art, accompanying drawings needed to be used for description of the embodiments or the prior art will be introduced briefly below. Apparently, the accompanying drawings in the description below merely show some embodiments of the present disclosure. A person ordinarily skilled in the art still can obtain other relevant drawings in light of these accompanying drawings, without using inventive effort.

Reference signs: 101—electric arc tube; 102—lamp holder; 103—outer glass bulb; 104—inner glass bulb; 105—positive contact pin; 106—negative contact pin; 107—ferrule; 108—tube body; 109—positive electrode; 110—negative electrode; 111—electric arc cavity; 112—positive feedthrough; 113—negative feedthrough; 114—short molybdenum rod; 115—long molybdenum rod; 116—conductive layer; 117—metal electrical connector; 118—first end ring portion; 119—second end ring portion; 120—intermediate section; 121—arc-shaped portion; 122—connecting portion; 123—fixing portion; 124—first straight-line section; 125—second straight-line section; 126—first straight side; 127—second straight side; 128—third straight side; 129—fourth straight side; 130—fifth straight side; 131—sixth straight side; 132—seventh straight side; 133—getter; 134—spring ring stand; 135—conductive foil; 136—electrode tip; 1081—first leg portion; 1082—second leg portion.

DETAILED DESCRIPTION OF EMBODIMENTS

Technical solutions of the present disclosure will be described below clearly and completely in combination with accompanying drawings. Apparently, the embodiments described are only some embodiments of the present disclosure, rather than all embodiments.

Generally, components in the embodiments of the present disclosure described and shown in the accompanying drawings herein can be arranged and designed in various different configurations. Therefore, the detailed description below of the embodiments of the present disclosure provided in the accompanying drawings is not intended to limit the scope of protection of the present disclosure, but merely represents chosen embodiments of the present disclosure.

Based on the embodiments in the present disclosure, all of other embodiments, obtained by a person ordinarily skilled in the art without using inventive effort; shall fall within the scope of protection of the present disclosure. Terms "first", "second", and "third" are merely used for descriptive purpose, but should not be construed as indicating or implying importance in the relativity.

In the description of the present disclosure, it should be noted that unless otherwise specified and defined clearly, terms "mount", "join", and "connect" should be understood in a broad sense, for example, a connection can be a fixed connection, a detachable connection, or an integrated connection; it can be a mechanical connection or an electrical connection; it can be a direct connection or an indirect connection through an intermediate medium, and it also can be an inner communication between two elements. For a person ordinarily skilled in the art, specific meanings of the above-mentioned terms in the present disclosure can be understood according to specific circumstances.

Figure 1:
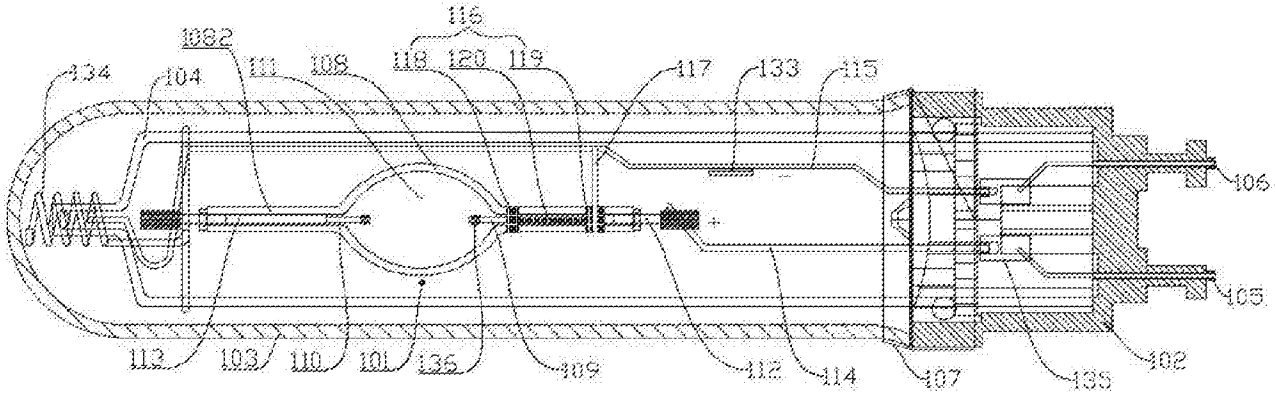
FIG. 1 is a structural schematic diagram of a metal halide lamp provided in an embodiment of the present disclosure.

Referring to FIG. 1, an embodiment of the present disclosure provides a metal halide lamp. The metal halide lamp is a ceramic metal halide lamp. The ceramic metal halide lamp includes an electric arc tube 101, a lamp holder 102, an outer glass bulb 103, and an inner glass bulb 104 (in order to show a structure of the metal halide lamp in a better manner, the lamp holder 102 and the outer glass bulb 103 in FIG. 1 are both in shown a cross-sectional view). The electric arc tube 101 is mounted inside the inner glass bulb 104, and the inner glass bulb 104 is mounted inside the outer glass bulb 103; the lamp holder 102 is fixedly connected with the inner glass bulb 104, and the inner glass bulb 104 is further fixedly connected with the outer glass bulb 103; the lamp holder 102 may be model 1-PGZX18 ceramic lamp holder 102 with two pins; the two pins of the lamp holder 102 have an interval of 18 mm, that is, a spacing between a positive contact pin 105 and a negative contact pin 106 of the lamp holder 102 is 18 mm. The outer glass bulb 103 and the lamp holder 102 are fixedly connected by a ferrule 107. The outer glass bulb 103 may be an explosion-proof quartz glass bulb. The inner glass bulb 104 may be a quartz glass bulb. The electric arc tube 101 is a light-emitting source of the metal halide lamp. A material of the ceramic metal halide lamp, i.e. the electric arc tube 101, is ceramic.

It further can be seen from the drawings that the outer glass bulb 103 is in a cylindrical barrel-shaped structure that is open at one end and closed at the other end. Moreover, the closed end of the outer glass bulb 103 is in smooth transition by means of an arc face. In the present embodiment, the closed end of the outer glass bulb 103 is in a semi-spherical shape. It can be understood that in other embodiments of the present disclosure, the closed end of the outer glass bulb 103 may be in any shape of flat plate shape, prismatic shape and other shapes, and what is illustrated here is merely an example.

Further, the lamp holder 102 is provided at the open end of the outer glass bulb 103. After the inner glass bulb 104 and the outer glass bulb 103 are fixedly connected, the inner glass bulb 104 is suspended in an inner cavity of the outer glass bulb 103. Moreover, the electric arc tube 101 is suspended inside the inner glass bulb 104.

The electric arc tube 101 includes a tube body 108, a positive electrode 109, and a negative electrode 110; wherein the positive electrode 109 is located inside an electric arc cavity 111 of the tube body 108, and the positive electrode 109 is electrically connected with a positive feedthrough 112, and the positive feedthrough 112 is inserted in a first leg portion 1081 of the tube body 108; the negative electrode 110 is located inside the electric arc cavity 111 of the tube body 108, the negative electrode 110 is electrically connected with the negative feedthrough 113, and the negative feedthrough 113 is inserted in a second leg portion 1082 of the tube body 108. The positive electrode 109 is located at an end of the positive feedthrough 112; the negative electrode 110 is located at an end of the negative feedthrough 113. The electric arc cavity 111 is substantially in an ellipsoidal shape, or in a cylindrical shape. The positive electrode 109 and the negative electrode 110 have a predetermined distance therebetween inside the electric arc cavity 111.

The positive feedthrough 112 is electrically connected with the positive contact pin 105 of the lamp holder 102 by a short molybdenum rod 114, and the negative feedthrough 113 is electrically connected with the negative contact pin 106 of the lamp holder 102 by a long molybdenum rod 115. Specifically, the other end of the positive feedthrough 112 is connected with one end of the short molybdenum rod 114, and the other end of the short molybdenum rod 114 is electrically connected with the positive contact pin 105 by means of a conductive foil 135. The other end of the negative feedthrough 113 is connected with one end of the long molybdenum rod 115, and the other end of the long molybdenum rod 115 is electrically connected with the negative contact pin 106 by means of the connecting foil 135.

An outer surface of the first leg portion 1081 is provided with a conductive layer 116 and a metal electrical connector 117, wherein one end of the conductive layer 116 is close to an electrode tip 136 of the positive electrode 109, the other end of the conductive layer 116 is away from the electrode tip 136 of the positive electrode 109, one end of the metal electrical connector 117 is connected with the other end of the conductive layer 116, and the other end of the metal electrical connector 117 is connected with the long molybdenum rod 115.

It should be indicated that a distance between the one end of the conductive layer 116 and the positive electrode 109 is not greater than one fifth of a distance between the positive electrode 109 and the negative electrode 110. Specifically, the distance between the one end of the conductive layer 116 and the positive electrode 109 is one tenth of the distance between the positive electrode 109 and the negative electrode 110. By providing the conductive layer 116, a distance between the metal electrical connector 117 and the positive electrode 109 may be allowed to be relatively long, thus avoiding influence of heat conduction by the metal electrical connector 117 on a pressure in the electric arc tube 101; moreover, it can further prevent the metal electrical connector 117 from being too close to a light-emitting part of the electric arc tube 101 with a high temperature, which causes occurrence of a situation that the metal electrical connector 117 is heated to deform and become loose, this is because when the metal electrical connector 117 is loose, the ignition will be severely affected, moreover the metal electrical connector 117 also can be prevented from blocking light and reducing the lumen efficiency of the electric arc tube 101.

In an optional solution of this embodiment, the other end of the positive feedthrough 112 and the one end of the short molybdenum rod 114 are connected by welding a nickel sleeve therebetween, and the other end of the negative feedthrough 113 and the one end of the long molybdenum rod 115 are connected by welding a nickel sleeve therebetween; in a welding process; the nickel sleeve can be sleeved on an end portion of a feedthrough (the positive feedthrough 112 or the negative feedthrough 113), then a molybdenum rod (the short molybdenum rod 114 or the long molybdenum rod 115) passes through the nickel sleeve in a radial direction; then is spot-welded or laser-welded.

Figure 2:
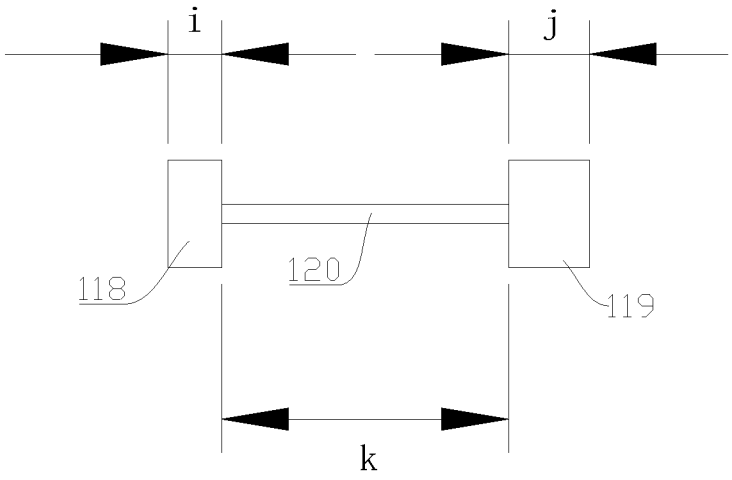
FIG. 2 is a structural schematic diagram of a conductive layer in an embodiment of the present disclosure.
Figure 3:
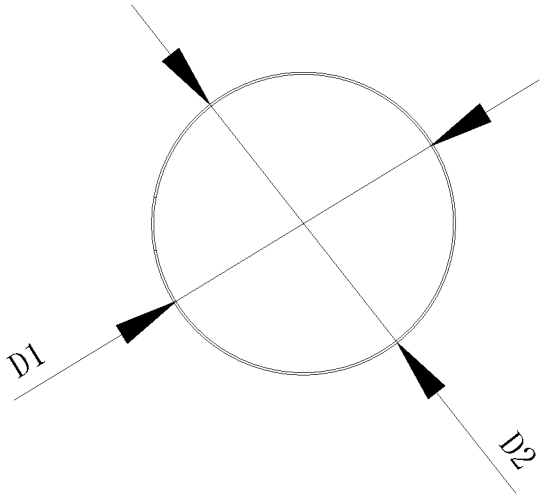
FIG. 3 is a structural schematic diagram of a first end ring portion in an embodiment of the present disclosure.

Further, referring to FIG. 1, FIG. 2; and FIG. 3, in an optional solution of the present embodiment, the conductive layer 116 includes a first end ring portion 118 and a second end ring portion 119 connected in sequence; wherein the first end ring portion 118 circumferentially surrounds the first leg portion 1081, and 1081; the second end ring portion 119 circumferentially surrounds the first leg portion 1081 the first end ring portion 118 is close to the electrode tip 136 of the positive electrode 109, and the second end ring portion 119 is away from the electrode tip 136 of the positive electrode 109; one end of the metal electrical connector 117 is connected with the second end ring portion 119. The first leg portion has a cross section substantially in a circular shape. In an optional solution of this embodiment; a width i of the first end ring portion 118 is 0.2 mm~10 mm; a width j of the second end ring portion 119 is 0.2 mm~10 mm (as shown in FIG. 2); thus a better electric field intensity and a better connection stability between the conductive layer 116 and the metal electrical connector 117 can be rendered.

Specifically, the width of the first end ring portion 118 may be 0.5 mm, 1 mm, 2 mm, 3 mm, 4 mm, 5 mm or 6 mm; the width of the second end ring portion 119 may be 0.5 mm, 1 mm, 2 mm, 3 mm, 4 mm, 5 mm or 6 mm.

Optionally, in an optional solution of this embodiment, the width of the first end ring portion 118 may be no greater than the width of the second end ring portion 119, and the width of the second end ring portion 119 is no less than the width of the metal electrical connector 117, thus tight connection between the metal electrical connector 117 and the second end ring portion 119 can be ensured, preventing occurrence of a situation of poor contact when the metal connection is displaced.

Referring to FIG. 2, in an optional solution of this embodiment, the conductive layer 116 further includes an intermediate section 120, wherein the first end ring portion 118 and the second end ring portion 119 are electrically connected through the intermediate section 120, thus facilitating increasing the distance between the metal electrical connector 117 and the positive electrode 109. By providing the conductive layer 116, the distance between the metal electrical connector 117 and the positive electrode 109 may be allowed to be relatively long, thus avoiding influence of heat conduction by the metal electrical connector 117 on the pressure in the electric arc tube 101; moreover, it can further prevent the metal electrical connector 117 from being too close to a light-emitting part of the electric arc tube 101 with a high temperature, which causes occurrence of a situation that the metal electrical connector 117 is heated to deform and become loose, this is because when the metal electrical connector 117 is loose, the ignition will be severely affected, moreover the metal electrical connector 117 also can be prevented from blocking light and reducing the lumen efficiency of the electric arc tube 101. It should be indicated that all of the three, the intermediate section 120, the first end ring portion 118, and the second end ring portion 119, may be integrally connected, and may also be connected in a split manner.

Optionally, in an optional solution of this embodiment, although the first end ring portion 118 and the second end ring portion 119 can be separated by providing the intermediate section 120, the intermediate section 120 should not be too long, therefore, therefore a length k (as shown in FIG. 2) of the intermediate section 120 should be no greater than 12 mm. Optionally, the length of the intermediate section 120 is 0~0.1 mm, 0.5 mm~1.2 mm, 9 mm, 10 mm, 10.5 mm, 10.8 mm or 11 mm.

Optionally, in an optional solution of this embodiment, a width of the intermediate section 120 may be smaller than the width of the first end ring portion 118, and/or the width of the intermediate section 120 may be smaller than the width of the second end ring portion 119. Optionally, the width of the intermediate section 120 is 2 mm~14 mm, and optionally may be 3 mm, 4 mm, 5 mm, 6 mm, 7 mm, 10 mm or 12 mm.

Further, in an optional solution of this embodiment, the conductive layer 116 may have a thickness of 0.001 mm~1 mm, that is to say, the first end ring portion 118, the second end ring portion 119, and the intermediate section 120 each have a thickness of 0.001 mm~1 mm. With the above thickness of the conductive layer 116, the electric field can be enhanced to a considerable extent. It should be indicated that there may be multiple intermediate sections 120, and the multiple intermediate sections 120 are distributed at uniform intervals circumferentially around the first leg portion 1081, for example, two intermediate sections 120 are provided, and the two intermediate sections are symmetrically arranged.

Specifically, the thickness of the conductive layer 116 may be 0.01 mm, 0.05 mm, 0.1 mm, 0.15 mm, 0.2 mm, 0.3 mm, 0.5 mm or 0.6 mm. It should be indicated that a thickness D1 of the first end ring portion 118 may be greater than the thickness of the intermediate section 120, and a thickness D2 of the second end ring portion 119 is greater than the thickness of the intermediate section 120. When the first end ring portion 118 is relatively thick, it is conducive to enhancement of the electric field. The thickness D1 of the first end ring portion 118 is greater than the thickness D2 of the second end ring portion 119, thus it is beneficial to stack a stronger electric field on the basis of the electric field intensity between the positive electrode and the negative electrode 110. Under the effect of the stacked electric fields, the negative electrode 110 of the electric arc tube 101 instantaneously emits more electrons, thereby a current is much larger, and the electrode instantaneously becomes more heated under the effect of the large current, and the more heated electrode emits more electrons under a high temperature.

Figure 4:
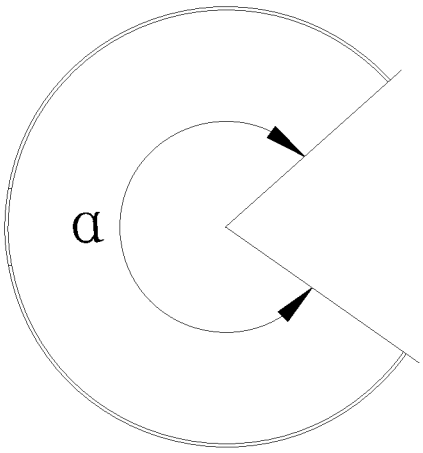
FIG. 4 is a schematic diagram of another variation structure of the first end ring portion in an embodiment of the present disclosure.

Further, referring to FIG. 3 and FIG. 4, in an optional solution of this embodiment, a central angle α corresponding to a contact arc between the first end ring portion 118 and the first leg portion 1081 is 10°~360°, that is to say, the first end ring portion 118 may be one complete ring (see FIG. 3), and also may be a part of a ring (see FIG. 4); a central angle α corresponding to a contact arc between the second end ring portion 119 and the first leg portion 1081 is 10°~360°, that is to say, the second end ring portion 119 may be one complete ring, and also may be a part of a ring, Optionally, the central angle corresponding to the contact arc between the first end ring portion 118 and the first leg portion 1081 may be 10°~180°, and further, this central angle may be 20°, 45°, 90°, 12° or 135°; the central angle α corresponding to the contact arc between the second end ring portion 119 and the first leg portion may be 10°~180°, and further, this central angle may be 20°, 45°, 90°, 120° or 135°. It should be indicated that the central angle corresponding to the contact arc between the first end ring portion 118 and the first leg portion 1081 may be greater than the central angle corresponding to the contact arc between the second end ring portion 119 and the first leg portion 1081, in this way, it facilitates establishing a relatively strong electric field, ensures to satisfy the requirement of restarting of the metal halide lamp, and improves reliability and stability of ignition of the electric arc tube 101.

Optionally, in an optional solution of this embodiment, a material of the tube body 108 is ceramic. The conductive layer 116 is coated on the first leg portion. The conductive layer 116 is formed by sintering a metal powder. Optionally, the conductive layer 116 is formed by sintering an aluminum oxide powder and/or a tungsten powder in a mixed manner; that is to say, after the conductive layer 116 is coated on the first leg portion, and formed by high-temperature sintering, the conductive layer 116 thereby is easily firmly connected with the tube body 108 of ceramic material. The temperature during sintering can be determined according to practical situations. By sintering the conductive layer 116 on the first leg portion, a situation that the conductive layer 116 is heated to deform and become loose due to a light-emitting part with high-temperature of the electric arc tube 101 can be avoided, thus ensuring to satisfy the requirement of starting of the metal halide lamp, improving reliability and stability of ignition of the electric arc tube 101, increasing the service life, and guaranteeing promised service life.

Further, referring to FIG. 5 to FIG. 10, in an optional solution of this embodiment, the metal electrical connector 117 is in a sheet-like structure, and the sheet-like structure includes an arc-shaped portion 121; a connecting portion 122, and a fixing portion 123, wherein the connecting portion 122 is electrically connected with one end of the arc-shaped portion 121, the fixing portion 123 is electrically connected with the other end of the arc-shaped portion 121; the arc-shaped portion 121 is attached to the first leg portion; the connecting portion 122 is electrically connected with the arc-shaped portion 121, and the connecting portion 122 is further electrically connected with the long molybdenum rod 115; and the fixing portion 123 is electrically connected with the connecting portion 122. It should be indicated that a thickness of the connecting portion 122 may be increased gradually from a first end to a second end of the connecting portion 122, the first end of the connecting portion 122 is electrically connected with one end of the arc-shaped portion 121, and the second end of the connecting portion 122 is electrically connected with the long molybdenum rod 115, in this way, it is beneficial to ensure the electrical conductivity of the metal electrical connector 117.

Optionally, the length of the connecting portion 122 is larger than the length of the fixing portion 123.

It should be indicated that the first end ring portion 118 and the second end ring portion 119 each may be one complete ring. In addition, a surface of the first end ring portion 118 in a width direction is substantially parallel to a surface of the second end ring portion 119 in a width direction, that is, an axial direction of the first end ring portion 118 is parallel to an axial direction of the second end ring portion 119. A length direction of the intermediate section 120 is parallel to a length direction of the first end ring portion 118. An axial direction of the arc-shaped portion 121 is parallel to the axial direction of the first end ring portion 118, in this way, it facilitates fixation of the conductive layer 116, and also facilitates parallel stacking of an electric field produced between the first end ring portion 118 and the positive electrode 109 with an electric field produced between the positive electrode and the negative electrode, thus resulting in a maximal intensity of the stacked electric fields. The metal electrical connector 117 may be, but is not limited to, any one of a sheet-like structure, a filament-shaped structure, a rod-shaped structure, a ring-shaped structure, a rectangular structure, a triangular structure, a sinusoidal waveform structure, a spiral structure and so on.

Optionally, in an optional solution of this embodiment, a central angle corresponding to an arc of the arc-shaped portion 121 is 0~360°, thus ensuring the electrical connection between the conductive layer 116 and the long molybdenum rod 115; that is to say, the metal electrical connector 117 may be in point connection, line connection or face connection with the conductive layer 116, and when this central angle is 0°, the metal electrical connector 117 is in point connection with the conductive layer 116. Optionally, the central angle corresponding to the arc of the arc-shaped portion 121 is 180° or 350°~360°, thus, after the fixing portion 123 is fixedly connected with the connecting portion 122, the arc-shaped portion 121 can become a complete circle encircling the first leg portion.

Figure 5:
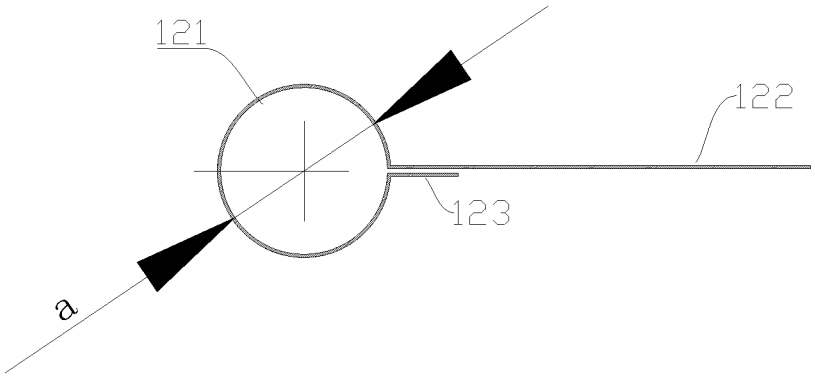
FIG. 5 is a structural schematic diagram of a metal electrical connector in an embodiment of the present disclosure.
Figure 6:
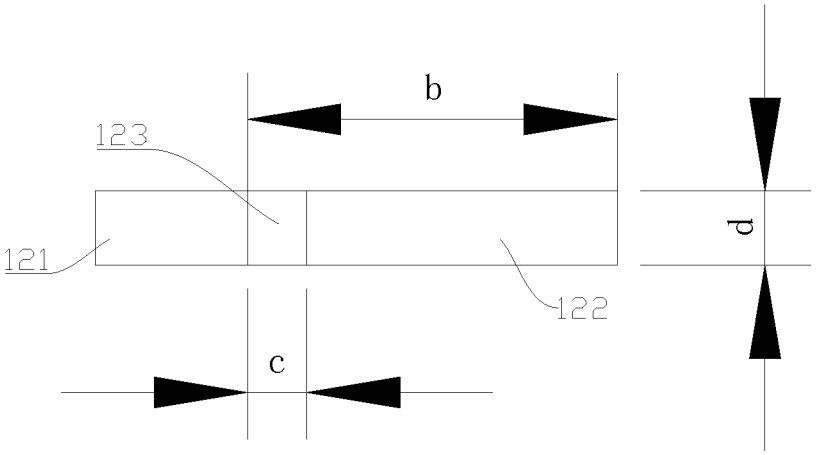
FIG. 6 is a structural schematic diagram of the metal electrical connector; from another angle of view, in an embodiment of the present disclosure.

Further, referring to FIG. 5 and FIG. 6, in an optional solution of this embodiment, a thickness of the sheet-like structure is 0.01 mm~1 mm; a width d of the sheet-like structure is 0.5 mm~5 mm, thus, it not only can facilitate establishing an electric field, but also can reduce the possibility of light blocking by the sheet-like structure. Optionally, the thickness of the sheet-like structure is 0.05 mm~0.1 mm, and the width of the sheet-like structure is 1 mm~3 mm. It should be indicated that in this embodiment, the thickness of the connecting portion 122 can be greater than the thickness of the arc-shaped portion 121, so as to ensure the service life of the connecting portion 122 in a using process.

Optionally, in an optional solution of this embodiment, an internal diameter a corresponding to the arc of the arc-shaped portion 121 is 3.80 mm~4.20 mm; and an external diameter corresponding to the arc of the arc-shaped portion 121 is 3.82 mm~5.20 mm.

Specifically, when the arc-shaped portion 121 is a circular ring, an internal diameter of this circular ring is 3.80 mm~4.20 mm; and an external diameter of this circular ring is 3.82 mm~5.20 mm.

Referring to FIG. 6, in an optional solution of this embodiment, two opposite end portions of the connecting portion 122 have a distance therebetween of 3 mm~15 mm, that is to say, a straight-line distance b between two ends of the connecting portion 122 in a length direction is 3 mm~15 mm. The provision of the length range of the connecting portion 122 facilitates reducing the possibility of light blocking by the sheet-like structure. Optionally, the distance between the two opposite end portions of the connecting portion 122 is 8 mm~12 mm, and further, the distance may be 9 mm, 10 mm or 11 mm. When the connecting portion 122 is in a straight-line shape, the length of the connecting portion 122 is the straight-line distance between two ends of the connecting portion 122 in the length direction; when the connecting portion 122 is bent in its length extension direction, the length of the connecting portion 122 is a straight-line distance between the two ends of the connecting portion 122 in the length distance, that is to say, no matter how the shape of the connecting portion 122 changes, the straight-line distance between the two ends thereof remains unchanged. It should be indicated that the connecting portion 122 in FIG. 5 and FIG. 6 is in a straight-line form. The length direction of the connecting portion 122 passes through a center point corresponding to the arc-shaped portion 121.

Optionally, in an optional solution of this embodiment, the fixing portion 123 has a length c of 0.5 mm~10 mm, optionally, the length of the fixing portion 123 is 1 mm~3 mm, and the length of the fixing portion 123 may also be 4 mm~6 mm, in this way, the fixing portion 123 and the connecting portion 122 can be better fixed.

Figure 7:
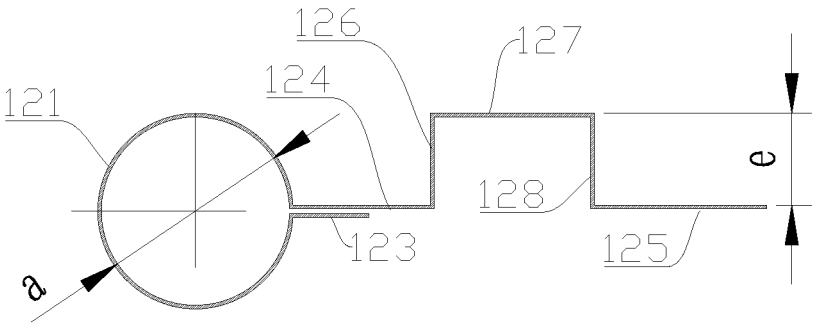
FIG. 7 is a schematic diagram of a second variation structure of the metal electrical connector in an embodiment of the present disclosure.

Optionally, in an optional solution of this embodiment, referring to in FIG. 7, the connecting portion 122 includes at least two straight-line sections and at least one bending section, and a difference between the number of the straight-line sections and the number of the at least one bending section is 1; end portions of each bending section are connected with the respective straight-line sections; the at least one bending section and the straight-line sections are distributed in an alternating manner, that is to say, when the straight-line sections and the at least one bending section of the connecting portion 122 are connected, each of two ends of each bending section is connected with one straight-line section, and each bending section is located between two respective straight-line sections. The bending section may be in a wavy form, a sinusoidal form, a spiral form, or a rectangular form with three sides, and so on. It should be indicated that the number of the at least one bending section also may be 2~4. The length direction of the straight-line sections is perpendicular to the arc-shaped portion 121, that is, the length direction of the straight-line sections passes through the center point corresponding to the arc-shaped portion 121.

Optionally, in this embodiment, detailed description is made taking that the number of the at least one bending section is one and the number of the straight-line sections is two as an example. The two straight-line sections are a first straight-line section 124 and a second straight-line section 125 respectively; one end of the first straight-line section 124 is connected with one end of the arc-shaped portion 121, the other end of the first straight-line section 124 is connected with one end of the bending section, the other end of the bending section is connected with one end of the second straight-line section, and the other end of the second straight-line section 125 is connected with the long molybdenum rod 115. The first straight-line section 124 and the second straight-line section 125 are located on a same horizontal plane.

Figure 8:
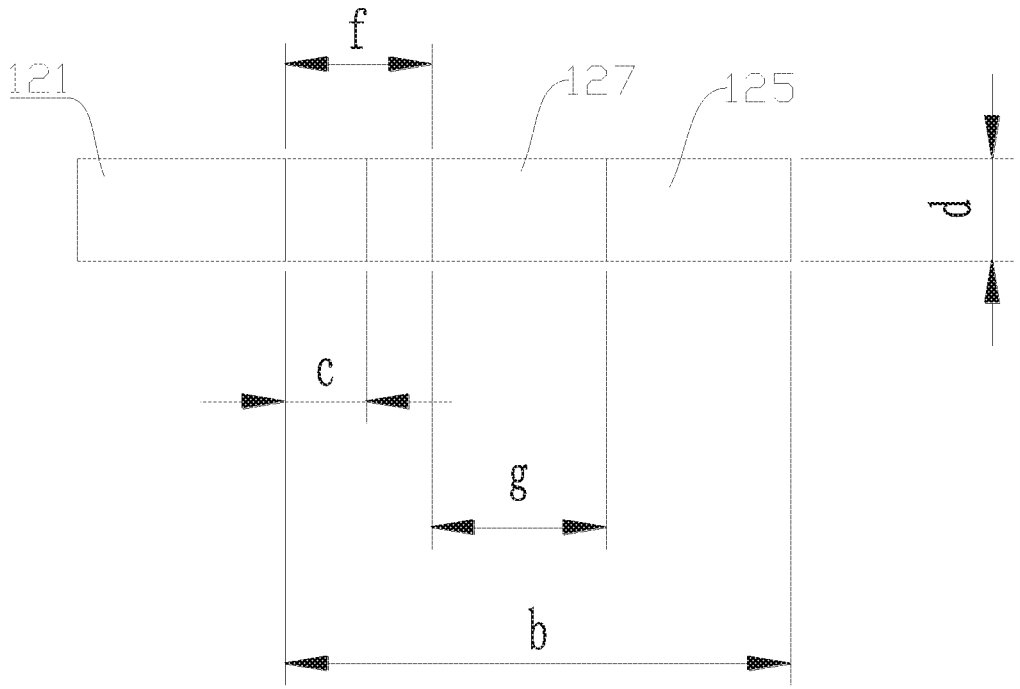
FIG. 8 is a structural schematic diagram of the second variation structure of the metal electrical connector, from another view of angle, in an embodiment of the present disclosure.

Further, referring to FIG. 7 and FIG. 8, in an optional solution of this embodiment, the bending section includes a first straight side 126, a second straight side 127, and a third straight side 128 connected in sequence, with the three straight sides forming a flat-top door shape; the first straight side 126 and the third straight side 128 are perpendicular to the second straight side 127 respectively; the first straight side 126 is further perpendicular to the straight-line sections; the third straight side 128 is further perpendicular to the straight-line sections; the second straight side 127 is parallel to the straight-line sections; the first straight side 126 is close to the arc-shaped portion 121, and the third straight side 128 is away from the arc-shaped portion 121. One end of the first straight-line section 124 is connected with one end of the first straight side 126, the other end of the first straight side 126 is connected with one end of the second straight side 127, the other end of the second straight side 127 is connected with one end of the third straight side 128, and the other end of the third straight side 128 is connected with one end of the second straight-line section 125.

Optionally, in an optional solution of this embodiment, a height e between the second straight side 127 and the straight-line sections is 1 mm~3 mm; optionally, the height between the second straight side 127 and the straight-line sections is 1.8 mm~2 mm, facilitating reducing the possibility of light blocking by the sheet-like structure.

Optionally, in an optional solution of this embodiment, a shortest distance between the arc-shaped portion 121 and a place where the first straight side 126 and the respective straight-line section are connected is 2 mm~8 mm, that is to say, a distance f between a place where the first straight side 126 and the first straight-line section 124 are connected and a place where the first straight-line section 124 and the arc-shaped portion 121 are connected is 2 mm~8 mm; optionally, a shortest distance between the arc-shaped portion 121 and the place where the first straight side 126 and the respective straight-line section are connected is 2 mm~8 mm, optionally 3 mm, 5 mm or 6 mm.

Optionally, in an optional solution of this embodiment, a length g of the second straight side 127 is 2 mm~8 mm. Optionally; the length of the second straight side 127 is 3 mm.

Figure 9:
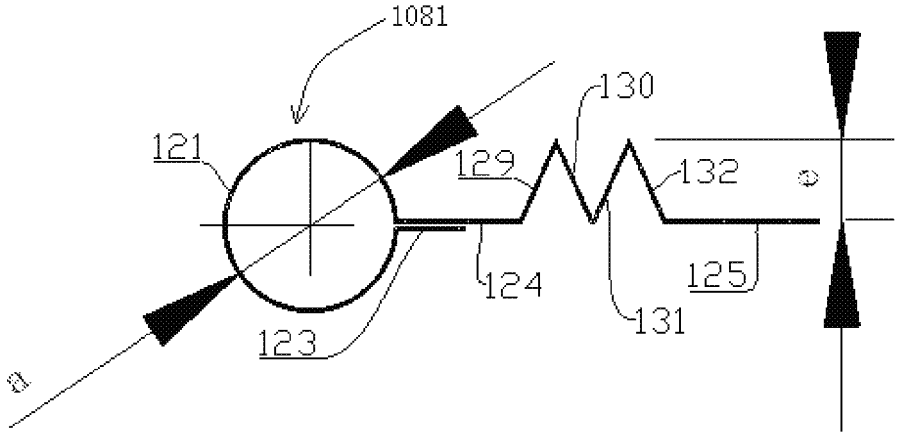
FIG. 9 is a schematic diagram of a third variation structure of the metal electrical connector in an embodiment of the present disclosure.
Figure 10:
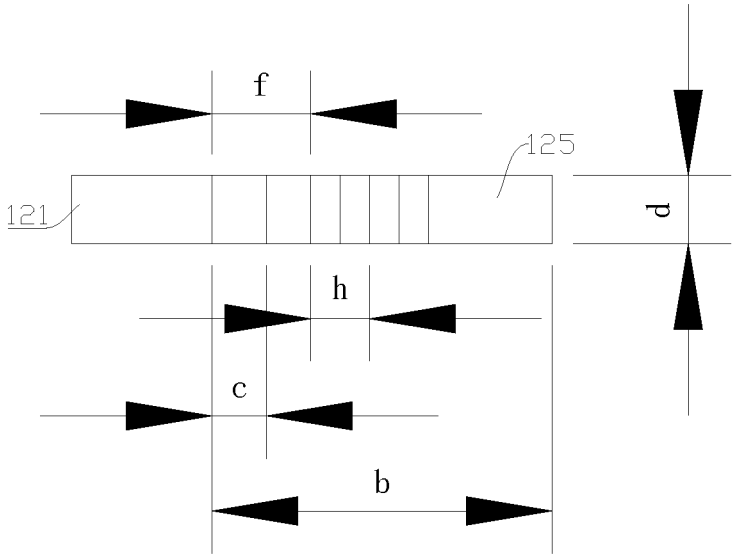
FIG. 10 is a structural schematic diagram of the third variation structure of the metal electrical connector, from another view of angle, in an embodiment of the present disclosure.

Referring to FIG. 9 and FIG. 10, in other embodiments of the present disclosure, the bending section includes a fourth straight side 129, a fifth straight side 130, a sixth straight side 131, and a seventh straight side 132 connected in sequence; none of the fourth straight side 129, the fifth straight side 130, the sixth straight side 131, and the seventh straight side 132 are parallel to the straight-line sections; the fourth straight side 129 is close to the arc-shaped portion 121, and the seventh straight side 132 is away from the arc-shaped portion 121. The fourth straight side 129 and the fifth straight side 130 form a peak-like door shape, and the sixth straight side 131 and the seventh straight side 132 form a peak-like door shape. One end of the first straight-line section 124 is connected with one end of the fourth straight side 129, the other end of the fourth straight side 129 is connected with one end of the fifth straight side 130, the other end of the fifth straight side 130 is connected with one end of the sixth straight side 131, the other end of the sixth straight side 131 is connected with one end of the seventh straight side 132, the other end of the seventh straight side 132 is connected with one end of the second straight-line section 125, and the other end of the second straight-line section 125 is connected with the long molybdenum rod 115.

Optionally, in an optional solution of this embodiment, an angle formed between the fourth straight side 129 and the fifth straight side 130 is equal to an angle formed between the sixth straight side 131 and the seventh straight side 132; the fourth straight side 129, the fifth straight side 130, the sixth straight side 131, and the seventh straight side 132 are all equal in length; an angle formed between the fourth straight side 129 and the respective straight-line section is equal to an angle formed between the seventh straight side 132 and the respective straight-line section.

Optionally, in an optional solution of this embodiment; a height e between the straight-line sections and a place where the fourth straight side 129 and the fifth straight side 130 are connected is 1 mm~3 mm; optionally; the height between the straight-line sections and the place where the fourth straight side 129 and the fifth straight side 130 are connected is 1.8 mm~2 mm.

Optionally, in an optional solution of this embodiment, a shortest distance f between the arc-shaped portion 121 and a place where the fourth straight side 129 and the respective straight-line section are connected is 2 mm~4 mm. Optionally, the shortest distance between the arc-shaped portion 121 and the place where the fourth straight side 129 and the respective straight-line section are connected is 3 mm.

Optionally, in an optional solution of this embodiment, a distance h between the place where the fourth straight side 129 and the respective straight-line section are connected and a place where the fifth straight side 130 and the sixth straight side 131 are connected is 1 mm~2 mm, that is to say, a distance between the place where the fourth straight side 129 and the first straight-line section 124 are connected and the place where the fifth straight side 130 and the sixth straight side 131 are connected is 1 mm~2 mm; optionally, the distance between the place where the fourth straight side 129 and the first straight-line section 124 are connected and the place where the fifth straight side 130 and the sixth straight side 131 are connected is 1.5 mm.

Figure 11:
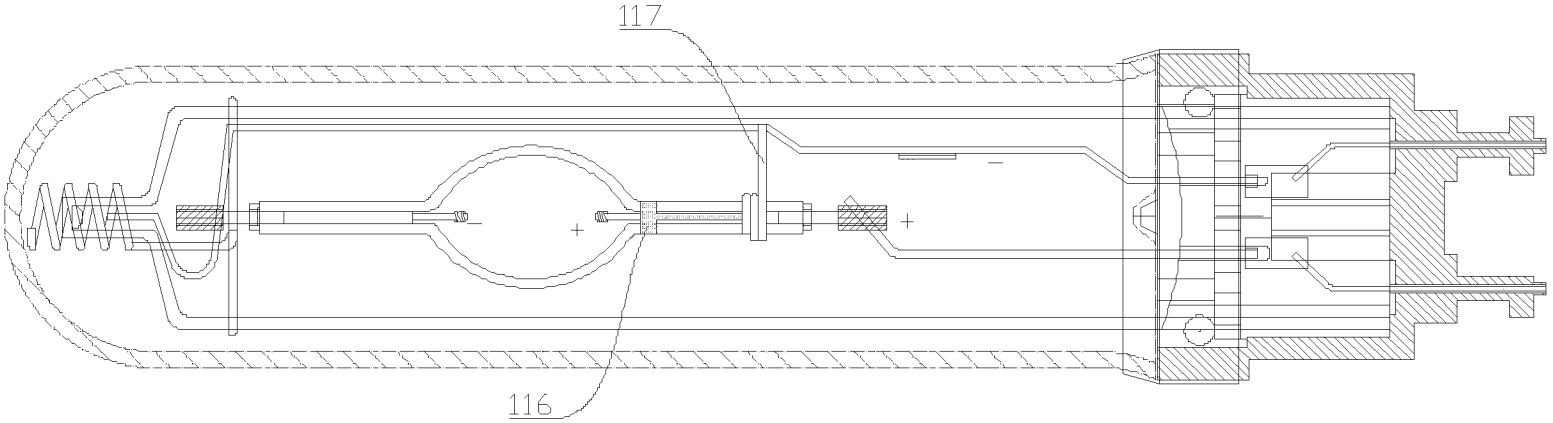
FIG. 11 is a structural schematic diagram of another variation structure of the metal halide lamp provided in an embodiment of the present disclosure.
Figure 12:
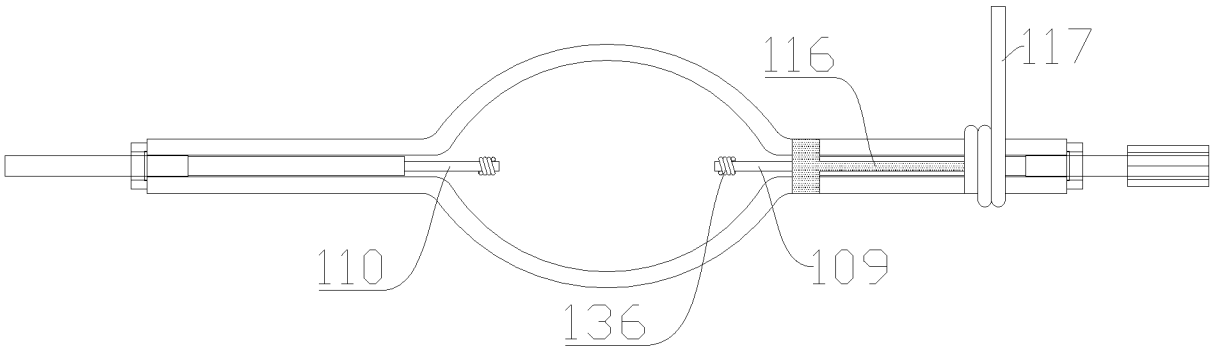
FIG. 12 is a structural schematic diagram illustrating that the metal electrical connector in FIG. 11 is mounted on an electric arc tube.

Further, it needs to be indicated that referring to FIG. 11 and FIG. 12, in this embodiment, the metal electrical connector 117 may also be in a filament-shaped structure. The filament-shaped structure is wound in a ring shape at the second end ring portion 119 and in close contact with the second end ring portion 119; a material of the filament-shaped structure is a high-temperature-resistant metal material, wherein the metal material includes, but is not limited to, nickel; niobium, tungsten; molybdenum, rhodium, or platinum, and so on; the filament-shaped structure may have a diameter of 0.1 mm~2 mm, optionally, the diameter of the filament-shaped structure is 0.3 mm~1 mm, and further, the diameter of the filament-shaped structure is 0.5 mm~0.8 mm. The diameter allows the filament-shaped structure to be wound on the first leg portion for 1 turns~20 turns, optionally, 1 turns~5 turns, and further, 2 turns~3 turns; the filament-shaped structure, after being wound, is welded with the long molybdenum rod 115 by spot welding. In this embodiment, it is also feasible to provide on an outer surface of the second leg portion 1802 the conductive layer 116 and the metal electrical connector 117 provided in an embodiment of the present disclosure, wherein one end of the conductive layer 116 is close to the electrode tip 136 of the negative electrode 110, the other end of the conductive layer 116 is away from the electrode tip 136 of the negative electrode 110, one end of the metal electrical connector 117 is connected with the other end of the conductive layer 116;

the other end of the metal electrical connector 117 is connected with the short molybdenum rod 114; that is to say, the first leg portion and/or the second leg portion is provided with the conductive layer 116 and the metal electrical connector 117.

Optionally, in an optional solution of this embodiment, a space inside the inner glass bulb 104 is in a vacuum state, or the space inside the inner glass bulb 104 is filled with nitrogen. Specifically, there are at least two following solutions of component arrangement inside the quartz inner glass bulb 104:

Solution 1, the electric arc tube 101 (the light-emitting source) and the long molybdenum rod 115 supporting the electric arc tube, the short molybdenum rod 114, the getter 133, and the metal electrical connector 117 may be sealed in vacuum inside the quartz inner glass bulb 104.

Solution 2, the electric arc tube 101 (the light-emitting source) and the long molybdenum rod 115 supporting the electric arc tube, the short molybdenum rod 114, the getter 133, and the metal electrical connector 117 may be sealed inside the quartz inner glass bulb 104 with inflation; the filled gas includes high-purity nitrogen, but is not limited to nitrogen; the inflation of the quartz inner glass bulb 104 can lower a temperature of a sealing part of the leg portion of the electric arc tube 101, so as to reduce a corrosiveness of a metal halide pellet to the sealing part of the leg portion of the electric arc tube 101, and decrease possibility of gas leakage of the electric arc tube 101, which has positive influences on both long-term reliability and service life of the electric arc tube 101.

Optionally, in an optional solution of this embodiment, the electric arc cavity 111 of the tube body 108 is provided therein with an ignition gas, wherein the ignition gas is an inert gas. A material of the tube body 108 may be ceramic. The electric arc cavity 111 is further filled therein with an illuminant and liquid mercury, wherein the illuminant is made of a light-emitting metal halide material; light-emitting the metal halide material includes at least one of sodium iodide, holmium iodide, dysprosium iodide, thallium iodide, calcium iodide, indium triiodide and so on; the liquid mercury is 99.99% high-purity mercury; the liquid mercury is added into the electric arc cavity 111 in an amount of 5 mg-50 mg, optionally 8 mg, 10 mg, 20 mg, 25 mg, 30 mg or 40 mg; the illuminant may be provided inside the electric arc cavity 111 in a powdered form or in a granular form, wherein the illuminant in a granular form may have a diameter of 0.1 mm~0.6 mm, and optionally 0.3 mm or 0.5 mm, and there may be multiple illuminants; for example, 1~30 illuminants; the ignition gas may be an inert gas, wherein the inert gas includes any one of argon and xenon, and optionally, the inert gas inside the electric arc cavity 111 is argon with a purity of 99.999%, the argon inside the electric arc cavity 111 has a gas pressure of 10 Kpa~70 Kpa, optionally; the gas pressure of the argon inside the electric arc cavity 111 is 20 Kpa~40 Kpa, and further, the gas pressure of the argon inside the electric arc cavity 111 is 25 Kpa, 30 Kpa, or 35 Kpa. The inner glass bulb 104 is further provided therein with the getter 133; wherein the getter 133 is a zirconium-aluminum alloy with nickel-clad iron as a substrate; the getter 133 can ensure timely adsorption of oxygen impurities and moisture impurities inside the inner glass bulb 104; ensuring that metal parts therein are not oxidized. The long molybdenum rod 115 has a diameter of 0.4 mm~1.5 mm, optionally, the diameter of the long molybdenum rod 115 is 0.8 mm; the short molybdenum rod 114 has a diameter of 0.5 mm~2.0 mm, and optionally, the diameter of the short molybdenum rod 114 is 1.0 mm, the getter 133 is fixed on the long molybdenum rod 115, and the getter 133 is close to a place where the positive feedthrough 112 and the short molybdenum rod 114 are connected.

Optionally, in an optional solution of this embodiment, the metal halide lamp further may include a spring ring stand 134; wherein the spring ring stand 134 is sleeved on a top portion of the inner glass bulb 104, in order to maintain stability of the inner glass bulb 104 inside the outer glass bulb 103. It can be seen from the figures that one end of the long molybdenum rod 115 extends towards the spring ring stand 134, until the long molybdenum rod is sleeved on the inner glass bulb 104; and an end portion of the long molybdenum rod 115 is disposed in a center of the spring ring stand 134.

An embodiment of the present disclosure further provides a manufacturing method of a metal halide lamp, wherein the manufacturing method mainly includes inflating an inner glass bulb 104.

A method of inflating the inner glass bulb 104 includes: providing a conductive layer 116 on a first leg portion of the electric arc tube 101, and enabling one end of the conductive layer 116 to be close to an electrode tip 136 of a positive electrode 109, and the other end of the conductive layer 116 to be away from an electrode tip 136 of the positive electrode 109;

further mounting a metal electrical connector 117 on the first leg portion of the electric arc tube 101, and enabling one end of the metal electrical connector 117 to be connected with the other end of the conductive layer 116, and the other end of the metal electrical connector 117 to be connected with the long molybdenum rod 115; and after flushing the space inside the inner glass bulb 104 multiple times with nitrogen, finally filling nitrogen with a pressure of $1*10^5$ Pa in one operation, then slowly pumping out the nitrogen, wherein when remaining nitrogen has a pressure of 50 Kpa~80 Kpa, an exhaust pipe on the inner glass bulb 104 is sealed up; or when the remaining nitrogen has a pressure of 100 Pa~1 Kpa, the exhaust pipe on the inner glass bulb 104 is sealed up; or when the remaining nitrogen has a pressure of 0.1 Pa~1 Pa, the exhaust pipe on the inner glass bulb 104 is sealed up, that is, the exhaust pipe on the inner glass bulb 104 is sealed and insulated.

A working principle of the metal halide lamp provided in the embodiments of the present disclosure is as follows:

Since a geometrical distance between the conductive layer 116 and the positive electrode 109 is particularly short, almost one tenth of a geometrical distance between the positive electrode and the negative electrode 110 of the electric arc tube 101, thus a much stronger electric field is stacked on the basis of the electric field intensity between the positive electrode and the negative electrodes 110. Under the effect of the stacked electric field, the negative electrode 110 of the electric arc tube 101 instantaneously emits much more electrons than electrons emitted by a negative electrode 110 of a common electric arc tube 101 without a conductive coating, thus the current is much larger, and the electrode instantaneously becomes more heated under the effect of the big current, the more heated electrode emits more electrons under a higher temperature, and under the effect of the electric field, numerous electrons break through the ignition gas—high-purity inert argon—inside the cavity of the electric arc tube 101, such that glow discharge occurs to the high-purity inert argon, and after the glow discharge, the temperature of the electrode rises dramatically, evaporating the liquid mercury and the metal halide inside the electric arc cavity 111, and arc discharge occurs to metallic vapor after evaporation of the liquid mercury and the metal halide under high pressure, thus forming a stable light-emitting source.

Further, the efficient and environment-friendly ceramic metal halide lamp free of radioactive gas $^{35}$Kr provided in an embodiment of the present disclosure includes a single-ended lamp and a double-ended lamp, wherein the single-ended lamp may be divided into explosion-proof type (protected type) for open fixtures and non-explosion-proof type for enclosed fixtures, wherein an explosion-proof lamp mainly consists of a non-explosion-proof bulb, an outer glass bulb 103 with an external diameter of 38 mm) of an explosion-proof quartz material provided outside the non-explosion-proof bulb, a spring ring stand 134, and a ferrule 107, and the metal halide lamp shown in FIG. 1 is an explosion-proof lamp; the non-explosion-proof lamp mainly consists of an inner glass bulb 104 (with an external diameter of 28 mm) of a quartz material, an electric arc tube 101, a long molybdenum rod frame 115, a short molybdenum rod bracket 114, a getter 133, a metal electrical connector 117, a lamp holder 102, a positive contact pin 105, and a negative contact pin 106. A color temperature of the electric arc tube 101 is 2000 K~10000 K, specifically may be 3000 K, 3500 K, or 4200 K, and a gas pressure of the high-purity argon inside the electric arc tube 101 is 10 Kpa~70 Kpa. The present disclosure thoroughly ended the history that an efficient ceramic metal halide lamp has to contain the radioactive gas including $^{85}$Kr otherwise it cannot be activated, therefore, safe manufacturing, transportation, mounting, reliable use and waste disposal after expiration of service life of the ceramic metal halide bulb having high color rendering property, high luminous efficiency, and high PAR value can be carried out without radioactive risks. The efficient and environment-friendly ceramic metal halide lamp free of radioactive gas $^{85}$Kr, can be widely used in fields such as road illumination, venue illumination, and plant illumination.

The electric arc tube, the conductive layer, and the metal electrical connector in a double-ended lamp structure are the same as those in the single-ended lamp in principles and forms, and further, the same principle and form of the conductive layer coated on the second leg portion of the negative electrode in the single-ended lamp are also applied; specifically, the conductive layer on the second leg portion where the negative electrode is located is connected with a positive feedthrough line of the first leg portion or an extension line thereof or a connection line thereof or a lead thereof using the metal electrical connector. The positive electrode and the negative electrode are relative concepts, and positions and directions thereof can be exchanged.

The metal halide lamp provided in the embodiments of the present disclosure at least has the following advantages:

coating the conductive layer 116 on the leg portions of the electric arc tube 101 renders high reliability, resistance to mechanical impacts, and no mechanical shedding; coating the conductive layer 116 on the leg portions of the electric arc tube 101 can almost 100% ensure an invariant distance between the positive electrode 109 and the negative electrode of the electric arc tube 101, high temperature resistance, non-deformation, and non-oxidation; the electric arc tube 101 no longer needs to contain the radioactive material including $^{85}$Kr to assist in starting of the bulb, thus thoroughly avoiding security risks in manufacturing, transportation, mounting, utilization, storage, and waste disposal brought about by use of the radioactive material.

It should be indicated that an ultraviolet bulb/tube or foil can further be mounted at the position of the leg portion of the electric arc tube 101 of the metal halide lamp provided in the embodiments of the present disclosure, while the bulb still needs $^{85}$Kr of small concentration.

The above-mentioned are merely for preferred embodiments of the present disclosure, and not used to limit the present disclosure. For one skilled in the art, various modifications and changes may be made to the present disclosure. Any amendments, equivalent replacements, improvements and so on made within the spirit and principle of the present disclosure should be covered within the scope of protection of the present disclosure.

INDUSTRIAL APPLICABILITY

In the present disclosure, a much stronger electric field is stacked on the basis of the electric field intensity between the positive electrode and the negative electrode, such that the ignition current is also much larger. Under the effect of the larger ignition current, the electrode is more heated, and the more heated electrode emits more electrons at a high temperature, so as to ensure lamp starting, and be capable of avoiding security risks in manufacturing, transportation, mounting, utilization, storage, and waste disposal brought about by use of the radioactive material $^{85}$Kr.

What is claimed is:

1. A metal halide lamp, comprising an electric arc tube, a lamp holder, an inner glass bulb and an outer glass bulb, wherein the electric arc tube is mounted inside the inner glass bulb, the lamp holder is fixedly connected with the inner glass bulb, and the inner glass bulb is mounted inside the outer glass bulb;

the electric arc tube comprises a tube body, a positive electrode, and a negative electrode, wherein the positive electrode is located inside an electric arc cavity of the tube body, and the positive electrode is connected with a positive feedthrough, and the positive feedthrough is inserted in a first leg portion of the tube body, and the electric arc cavity of the tube body is provided therein with an activating gas;

an negative electrode is located inside the electric arc cavity of the tube body, the negative electrode is connected with the negative feedthrough, and the negative feedthrough is inserted in a second leg portion of the tube body;

the positive feedthrough is connected with a positive contact pin of the lamp holder by a short molybdenum rod, and the negative feedthrough is connected with a negative contact pin of the lamp holder by a long molybdenum rod, wherein the short molybdenum rod has one end connected with the positive feedthrough, and an other end electrically connected with the positive contact pin through a first conductive foil, and the long molybdenum rod has one end connected with the negative feedthrough, and an other end electrically connected with the negative contact pin through a second conductive foil; and an outer surface of the first leg portion is provided with a conductive layer and a metal electrical connector, wherein one end of the conductive layer is close to an electrode tip of the positive electrode, an other end of the conductive layer is away from the electrode tip of the positive electrode, one end of the metal electrical connector is connected with the other end of the conductive layer, and an other end of the metal electrical connector is connected with the long molybdenum rod, wherein the metal electrical connector is in a sheet-like structure, and the sheet-like structure comprises an arc-shaped portion, a connecting portion, and a fixing portion, wherein the connecting portion is connected with one end of the arc-shaped portion, the fixing portion is connected with the other end of the arc-shaped portion; the arc-shaped portion is attached to the first leg portion; the connecting portion is connected with the arc-shaped portion, and the connecting portion is further connected with the long molybdenum rod; and the fixing portion is connected with the connecting portion.

2. The metal halide lamp according to claim 1, wherein the conductive layer comprises a first end ring portion and a second end ring portion connected in sequence; the first end ring portion circumferentially surrounds the first leg portion, and the second end ring portion circumferentially surrounds the first leg portion; the first end ring portion is close to the electrode tip of the positive electrode, and the second end ring portion is away from the electrode tip of the positive electrode; and the one end of the metal electrical connector is connected with the second end ring portion.

3. The metal halide lamp according to claim 2, wherein the conductive layer further comprises an intermediate section, and the first end ring portion and the second end ring portion are connected through the intermediate section.

4. The metal halide lamp according to claim 2, wherein a central angle corresponding to a contact arc between the first end ring portion and the first leg portion is 10°~360°; and a central angle corresponding to a contact arc between the second end ring portion and the first leg portion is 10°~360°.

5. The metal halide lamp according to claim 3, wherein a width of the first end ring portion is no greater than a width of the second end ring portion.

6. The metal halide lamp according to claim 3, wherein a thickness of the first end ring portion is greater than a thickness of the intermediate section, and a thickness of the second end ring portion is greater than the thickness of the intermediate section.

7. The metal halide lamp according to claim 1, wherein the connecting portion comprises at least two straight-line sections and at least one bending section, and a difference between the number of the straight-line sections and the number of the at least one bending section is 1; end portions of each of the at least one bending section are connected with the respective straight-line sections; the at least one bending section and the straight-line sections are distributed in an alternating manner.

8. The metal halide lamp according to claim 7, wherein the bending section comprises a first straight side, a second straight side, and a third straight side connected in sequence; the first straight side and the third straight side are perpendicular to the second straight side respectively; the first straight side is further perpendicular to the straight-line sections; the third straight side is further perpendicular to the straight-line sections; the second straight side is parallel to the straight-line sections; the first straight side is close to the arc-shaped portion, and the third straight side is away from the arc-shaped portion.

9. The metal halide lamp according to claim 7, wherein the bending section comprises a fourth straight side, a fifth straight side, a sixth straight side, and a seventh straight side connected in sequence; none of the fourth straight side, the fifth straight side, the sixth straight side, and the seventh straight side are parallel to the straight-line sections; the fourth straight side is close to the arc-shaped portion, and the seventh straight side is away from the arc-shaped portion.

10. The metal halide lamp according to claim 9, wherein an angle formed between the fourth straight side and the fifth straight side is equal to an angle formed between the sixth straight side and the seventh straight side; a length of the fourth straight side, a length of the fifth straight side, a length of the sixth straight side, and a length of the seventh straight side are all equal; an angle formed between the fourth straight side and the respective straight-line section is equal to an angle formed between the seventh straight side and the respective straight-line section.

11. The metal halide lamp according to claim 1, wherein a thickness of the connecting portion is greater than a thickness of the arc-shaped portion.

12. The metal halide lamp according to claim 1, wherein a space inside the inner glass bulb is in a vacuum state, or the space inside the inner glass bulb is provided with nitrogen.

13. The metal halide lamp according to claim 1, wherein the activating gas is an inert gas; and the inner glass bulb is further provided therein with a getter.

14. The metal halide lamp according to claim 1, wherein a central angle corresponding to an arc of the arc-shaped portion is 0~360°.

15. The metal halide lamp according to claim 1, wherein the inner glass bulb is further fixedly connected with the outer glass bulb; and the conductive layer has a thickness of 0.001 mm~1 mm.

16. The metal halide lamp according to claim 1, wherein the conductive layer is coated on the first leg portion.

17. The metal halide lamp according to claim 16, wherein the conductive layer is formed by sintering a metal powder.

18. The metal halide lamp according to claim 17, wherein the conductive layer is formed by sintering an aluminum oxide powder and a tungsten powder in a mixed manner.

19. A manufacturing method of the metal halide lamp according to claim 1, comprising steps of:

providing a conductive layer on a first leg portion of the electric arc tube; and enabling one end of the conductive layer to be close to an electrode tip of a positive electrode, and the other end of the conductive layer to be away from the electrode tip of the positive electrode;

mounting a metal electrical connector on the first leg portion of the electric arc tube, and enabling one end of the metal electrical connector to be connected with the other end of the conductive layer, and the other end of the metal electrical connector to be connected with the long molybdenum rod; and finally filling, after washing a space inside the inner glass bulb multiple times using nitrogen, nitrogen with a pressure of $1*10^5$ Pa in one operation, then slowly extracting the nitrogen, wherein when remaining nitrogen has a pressure of 80 Kpa~50 Kpa or 1 KPa~100 pa, an exhaust pipe on the inner glass bulb is sealed up.

* * * * *